United States Patent [19]

Zurcher

[11] 4,062,181

[45] Dec. 13, 1977

[54] COMBINATION WATCH-CALCULATOR CONSTRUCTION

[75] Inventor: Rudolf F. Zurcher, Newport Beach, Calif.

[73] Assignee: Hughes Aircraft Company, Culver City, Calif.

[21] Appl. No.: 649,885

[22] Filed: Jan. 16, 1976

[51] Int. Cl.[2] ..... G04B 37/00; H01H 13/70

[52] U.S. Cl. ..... 58/152 R; 58/23 R; 200/5 A; 200/159 A

[58] Field of Search ..... 58/23 R, 23 BA, 50 R, 58/85.5, 88 R, 152 R; 200/5 A, 159 A, 275

[56] References Cited

U.S. PATENT DOCUMENTS

| | | | |
|---|---|---|---|
| 2,519,899 | 8/1950 | Gatnor | 200/159 A |
| 3,673,357 | 6/1972 | Molchan | 200/5 A |
| 3,803,834 | 4/1974 | Reese | 58/152 R |
| 3,846,971 | 11/1974 | Ho et al. | 58/50 R |
| 3,858,019 | 12/1974 | Muri et al. | 200/159 A |
| 3,870,840 | 3/1975 | Rivetta et al. | 200/5 A |
| 3,974,351 | 7/1976 | Solov et al. | 200/159 A |
| 3,992,870 | 11/1976 | Dekel | 58/23 BA |

*Primary Examiner*—Robert K. Schaefer
*Assistant Examiner*—Vit W. Miska
*Attorney, Agent, or Firm*—Allen A. Dicke, Jr.; W. H. MacAllister

[57] ABSTRACT

Push button switches extending through the case wall of an electronic device, such as a combination watch-calculator engage on a three finger flat spring positioned so that one finger is in continuous electric contact and at least one finger can be pressed by the first button into engagement with an internal electrical contact point to provide manual signaling into the electronics.

8 Claims, 3 Drawing Figures

COMBINATION WATCH-CALCULATOR CONSTRUCTION

BACKGROUND

This invention is directed to switch construction for signaling electronics, particularly a switch suited for the control of an electronic device such a digital watch.

Modern digital watches contain fixed frequency sources which provide pulses which are divided to a pulse rate of horological value and which provide an input signal to a horological memory. Manual signaling of the memory controls the output of the memory into a display, such as a liquid crystal or LED display. The prior switches take on many different forms, but water tight character, ease of operation and reliability are desired ends. One prior patent showing a manually operable switch for control of the watch electronics is R. F. Zurcher and I. B. Merles U.S. Pat. No. 3,838,568. Another is shown in R. A. Burke and B. Somogyi U.S. Pat. No. 3,978,653. Another is shown in B. Somogyi U.S. Pat. No. 3,991,554. These patents also show various portions of the mechanical structure of digital electronic watches for which the present switch contact construction is also useful.

The present switch construction is shown in conjunction with a combination watch-calculator, but is useful in any type of electronic equipment where it is necessary that a manually operable button extending from the case manages control internal switching. More details of the combination watch-calculator are shown in Epperson, Belardi, and Merles application Ser. No. 653,189 filed Jan. 28, 1976 and Rudolf Zurcher Patent Application Ser. No. 653,320 filed Jan. 29, 1976, both assigned to the assignee of this invention.

SUMMARY

In order to aid in the understanding of this invention it can be stated in essentially summary form that it is directed to an electronic digital watch construction wherein a push button extends through the case wall and contacts one finger of a bifurcated flat metal spring, the other finger of which is in contact with a conductor of particular voltage so that upon pressing of the button, the contacted finger moves to touch that voltage to a fixed contact part in the watch electronics.

It is thus an object of this invention to provide an electronic watch control push button which extends through the watch case so that it can be manually operated to electrically control circuits in the watch. It is another object to provide an economic and trouble free push button switch for a digital electronic watch, with the push button switch being of the economic and reliable construction.

It is a further object to provide a push button switch mechanism for an electronic watch construction wherein a spring is mounted interiorly of the case of the watch, and the push button extends through the case wall to move the spring into contact with a fixed contact to be energized.

Other objects and advantages of this invention will become apparent from the study of the following portion of the specification, the claims and the attached drawings.

DESCRIPTION

Figure 1:
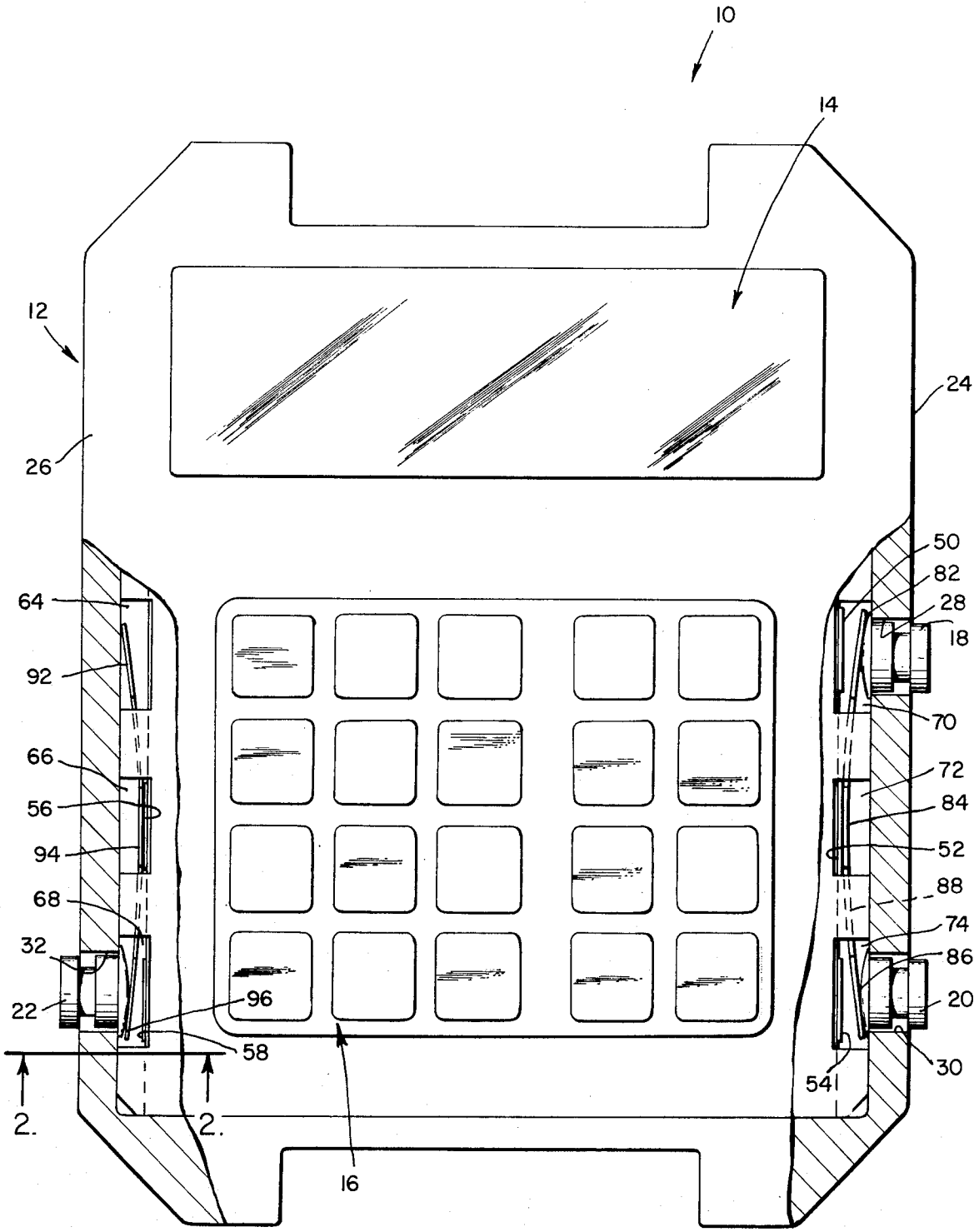
FIG. 1 is a top plan view of a combination watch-calculator construction, with parts broken away and parts taken in section, showing the switch mechanism of this invention in connection therewith.

The electronic device 10 shown in FIG. 1 of the combination watch-calculator which has a case 12 which contains the batteries and electronics of the device. Display 14 is visible through the face of the case while keyboard 16 is manually accessible from the front of the case. Electronics within the case interconnect the keyboard and display so that upon proper actuation of the keyboard, mathematical processes can be completed and the results shown on display 14. The electronics also include horological equipment including a standard frequency source, a divider train and a horological memory so that upon actuation the horological memory can display its contents on display 14 so that the device also acts as a digital watch. Actuation of the watch and display of the contents of its horological memory is accomplished by push buttons 18, 20 and 22 which extend through the wall of the case and are manually accessible. There are several types of information that can be displayed, such as hours and minutes, seconds, month and day date and a stop watch function is also possible. The push buttons 18, 20 and 22 are connected to energize the watch electronics and connect the proper horological memory to the display so that the desired information is displayed.

Figure 2:
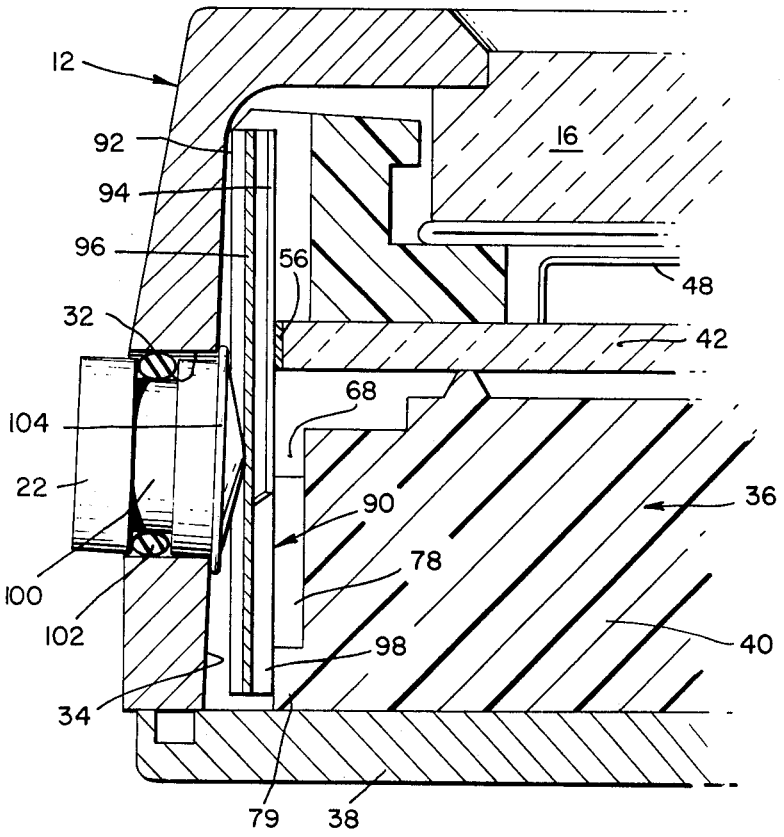
FIG. 2 is an enlarged section taken generally along the lines 2—2 of FIG. 1.

As is seen in FIGS. 1 and 2, case 12 has sidewalls 24 and 26 and the push buttons are respectively positioned within openings 28, 30 and 32 within the sidewalls. The sidewalls enclose cavity 34 which contains the electronic assembly 36. Cover 38 encloses the back.

Electronics assembly 36 comprises mounting block 40 which is made of insulating material, such as injection molded polycarbonate, or other synthetic polymer composition material of the proper mechanical and electrical properties. Block 40 is molded with all the necessary slots and openings to permit economic assembly of the electronic device. Electronic substrate 42 is preferably a rigid substrate which carries printed circuitry 44 and integrated circuit chips under cover 48, with the integrated circuit chips having the electronics for the calculating and horological functions. Electronic substrate 42 has pads 50, 52 and 54 plated around the edge, with pad 52 connected to the case voltage which is the same as the intermediate battery voltage, and pads 50 and 54 are connected to the watch electronics. Similarly, pads 56 and 58 are plated around the far edge of the substrate 42 with pad 56 connected to the intermediate voltage and pad 58 connected to the watch electronics. If desired, one of the pads could be connected to the calculator electronics for control thereof, such as turning the calculator on. Instead of plating the pads around the edge of the substrate, an edge clamp can be employed to clamp over the edge.

Guide channels 60 and 62 retain electronic substrate 42 in position in mounting block 40. Slots 64, 66 and 68 are formed in the side of mount block 40 on one side and slots 70, 72 and 74 are formed on the other side. The slots intersect with guide channels 60 and 62 so that the edges of electronic substrate 42 extend into the slots and the pads 50, 52, 54, 56 and 58 respectively appear in the corresponding slots. Each set of three slots is connected by a cross channel, with cross channel 76 extending through mounting block 40 beneath slots 70, 72 and 74 and cross channel 78, see FIG. 2, extending across the bottom of slots 64, 66 and 68. Spacer blocks 77 and 79 are respectively positioned in the bottoms of the cross channels.

Figure 3:
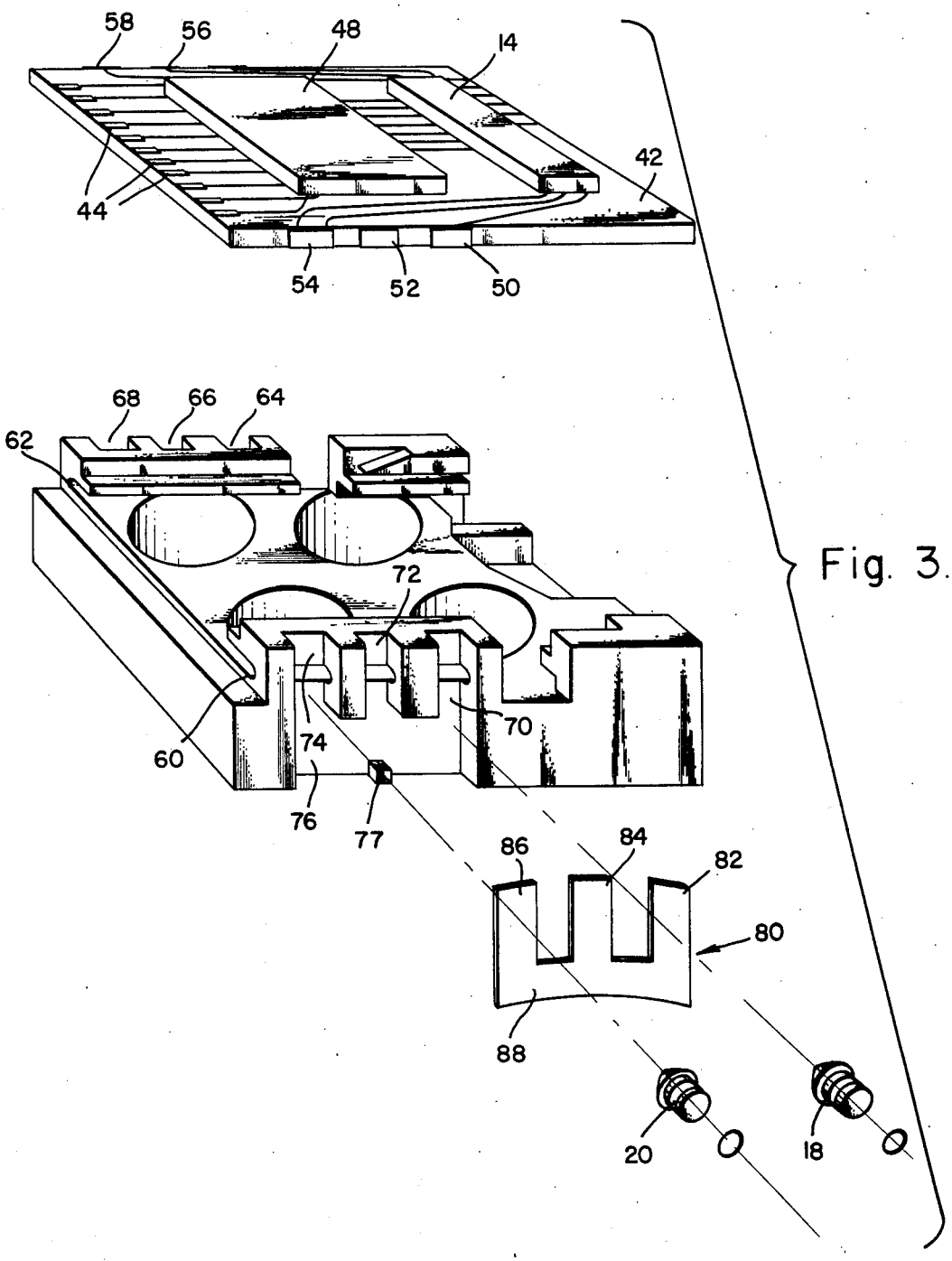
FIG. 3 is an exploded view of the watch-calculator showing the interrelated parts of the switch mechanism.

FIG. 3 shows contact spring 80 which has three contact fingers 82, 84 and 86 which are connected together across rib 88. Spring 80 has cylindrical curvature with its axis parallel to the fingers and lies so that its fingers 82, 84 and 86 respectively lie in slots 70, 72 and 74, with rib 88 lying in cross channel 76. With this curvature, the center finger 84 presses against pad 52 on electronic substrate 42, see FIG. 1, and the outer fingers 82 and 86 press outwardly toward the interior of that case wall. Rib 88 presses against spacer blade 77.

Similarly, contact spring 90 is of the same configuration with three upstanding fingers 92, 94 and 96, see FIGS. 1 and 2, which are connected with rib 98. These spring fingers lie in the slots 64, 66 and 68 while rib 98 lies in cross channel 78, pressing against spacer block 79, see FIG. 2. Contact spring 90 is identical to contact spring 80 and has the same curvature. The center finger 94 of contact spring 90 lies against pad 56 while spring contact finger 96 lies away from pad 58.

Each of the push buttons 18, 20 and 22 is identical, and as can be seen in FIG. 2, each of them has a cylindrical body with an o-ring groove 100 which contains o-ring 102. Head 104 is positioned inside the case wall and is of larger diameter than opening 32 to prevent the outward loss of push button. The o-ring seals the push button in its opening, and permits manual depression of the the push button. The push buttons may be non-metallic, but are preferably metallic for long wear life.

The case and spring are each at case potential, because the pads 52 and 56 are at intermediate battery potential which is the same as case potential. The push buttons are respectively positioned to engage the outside of spring fingers 82, 86 and 96. The resiliency of the spring finger thrust the push buttons outward to the rest position shown in FIGS. 1 and 2, out of contact with the corresponding pads. When manually engaged, the push buttons can be pressed in to resiliently deflect the spring fingers until each spring finger touches the corresponding pad. Thus, when push button 18 is depressed, spring finger 82 is deflected until it contacts pad 50. Similarly, when push button 20 is pressed it deflects spring finger 86 until it contacts pad 54. Furthermore, when push button 22 is depressed it deflects spring finger 96 until it contacts pad 58. The resiliency of the contact spring permits it to act as the return for the push buttons and to move the contact fingers away from the contact pad, when manual pressure is released.

Since the contact springs are at the intermediate, case voltage, this voltage is applied to the pads to cause an appropriate result in the watch electronics, and accompanied by the corresponding display. Thus, it can be seen that a reliable and economic contact system is produced so that manual operation can cause signaling to the electronics to achieve the desired result and display. Of course, the different push buttons can be connected into the electronics to achieve selected results, as described above.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. An electronic device comprising:

a case having a side wall;

a mounting block mounted within said case, a substrate mounted on said mounting block and electronic components mounted on said substrate, at least first and second electric contacts on said substrate lying along a line;

a metallic spring having first, second and third fingers extending from a rib, said rib resiliently holding said fingers along a line parallel to said rib, at least one of said lines being curved, said spring being mounted between said mounting panel and said case, said spring being formed so that said second finger resiliently engages said second contact on said substrate and said first finger is resiliently urged away from said first contact on said substrate; and a manually operated actuator mounted on said case and positioned to engage said first finger and move it into said contact with said first contact on said substrate so that electrical continuity is achieved from said first contact through said spring to said second contact.

2. The electronic device of claim 1 wherein said electronic device is an electronic horological instrument and said case is the case housing of said horological instrument, digital horological display means in said case and mounted with respect to said mounting block, said case having an opening in the front thereof for viewing of said display means.

3. The horological instrument of claim 2 wherein said manually operable switch actuator is a push button extending through an opening in said case wall and extending exteriorly of said case wall so that manual engagement of the portion of said push button exterior of said case wall causes movement of said push button in the direction through said case wall and causes contact of said first spring finger with said first contact.

4. The horological instrument of claim 3 wherein said push button has a head interiorly of said case wall to prevent movement of said push button out of said case.

5. The horological instrument of claim 3 wherein said push button is a first push button and there is also a second push button extending through said case wall, said first and second push buttons respectively engaging said first and third fingers of said contact spring and there is a third contact on said substrate, said third contact being positioned to be engaged by said third contact finger upon actuation of said second push button.

6. The horological instrument of claim 3 wherein said substrate is an electronic substrate having printed circuitry thereon and having integrated circuit chips mounting thereon and said display being mounted thereon so that substantially all of the electronics of said horological device is mounted thereon.

7. The horological instrument of claim 4 wherein said push button is sealed in the push button opening through said case wall by means of a ring seal engaged therebetween.

8. The horological device of claim 6 wherein a keyboard is mounted on said mounting block and said electronics includes calculator electronics, said display being connected for display of calculator functions as well as being connected for display of horological functions, said push buttons being connected for control of the display of horological functions.

* * * * *